US010335796B2

(12) United States Patent
Harthoorn et al.

(10) Patent No.: US 10,335,796 B2
(45) Date of Patent: Jul. 2, 2019

(54) SIZING SCREENS FOR COMMINUTING MACHINES

(71) Applicant: Vermeer Manufacturing Company, Pella, IA (US)

(72) Inventors: Duane Allen Harthoorn, Lynnville, IA (US); Greg Williams, Pella, IA (US); Jerry Patterson, Prairie City, IA (US)

(73) Assignee: Vermeer Manufacturing Company, Pella, IA (US)

( * ) Notice: Subject to any disclaimer, the term of this patent is extended or adjusted under 35 U.S.C. 154(b) by 67 days.

(21) Appl. No.: 15/362,387

(22) Filed: Nov. 28, 2016

(65) Prior Publication Data

US 2017/0165676 A1 Jun. 15, 2017

Related U.S. Application Data

(63) Continuation of application No. 13/748,379, filed on Jan. 23, 2013, now abandoned.

(60) Provisional application No. 61/593,613, filed on Feb. 1, 2012.

(51) Int. Cl.

| | |
|---|---|
| ***B02C 13/284*** | (2006.01) |
| ***B02C 13/04*** | (2006.01) |
| ***B02C 13/13*** | (2006.01) |
| ***B07B 1/46*** | (2006.01) |
| *B02C 23/16* | (2006.01) |

(52) U.S. Cl.

CPC ..... *B02C 13/284* (2013.01); *B02C 13/04* (2013.01); *B02C 13/13* (2013.01); *B07B 1/469* (2013.01); *B02C 2023/165* (2013.01)

(58) Field of Classification Search

CPC ..... B07B 1/46; B07B 1/4609; B07B 1/4618; B07B 1/4627; B07B 1/4636; B07B 1/4645; B07B 1/4651; B07B 1/4663; B07B 1/4672; B07B 1/4681; B07B 1/469; B02C 13/284; B02C 23/08; B02C 23/16; B02C 2023/165

USPC ..... 209/363, 392, 397–399, 401, 634, 683, 209/680

See application file for complete search history.

(56) References Cited

U.S. PATENT DOCUMENTS

| | | | |
|---|---|---|---|
| 5,507,441 | A | 4/1996 | De Boef et al. |
| 6,442,495 | B1 | 8/2002 | Fleming-Dahl |
| 6,840,471 | B2 | 1/2005 | Roozeboom et al. |
| 6,843,435 | B2 | 1/2005 | Verhoef et al. |
| 6,978,955 | B2 | 12/2005 | Verhoef et al. |
| 7,077,345 | B2 | 7/2006 | Byram et al. |
| 7,204,442 | B2 | 4/2007 | Roozeboom et al. |
| 7,213,779 | B2 | 5/2007 | Roozeboom et al. |
| 7,441,719 | B2 | 10/2008 | Verhoef et al. |
| 7,461,802 | B2 | 12/2008 | Smidt et al. |

(Continued)

*Primary Examiner* — Charles A Fox
*Assistant Examiner* — Kalyanavenkateshware Kumar
(74) *Attorney, Agent, or Firm* — Merchant & Gould P.C.

(57) ABSTRACT

A grinder for grinding relatively loose materials includes a reducing unit and a screen arrangement. The arcuate screen defines a plurality of tracks of apertures that extend in a cutting direction of the cutters. In some cases, only one respective cutter passes over each track and each cutter passes over only the respective one of the tracks. The width of a cutter may be greater than a width of the apertures of a track. The apertures of the screen arrangement may form chevron patterns. The screens may be clamped to a frame by coupling members extending through notches in the screen.

27 Claims, 13 Drawing Sheets

(56) References Cited

U.S. PATENT DOCUMENTS

| | | | |
|---|---|---|---|
| 7,896,274 | B2 | 3/2011 | Roozeboom |
| 7,959,097 | B2 | 6/2011 | De Boef |
| 7,971,818 | B2 | 7/2011 | Smidt et al. |
| 8,104,701 | B2 | 1/2012 | Smidt et al. |
| 8,245,961 | B2 | 8/2012 | Vroom et al. |
| 8,567,706 | B2 | 10/2013 | Bradley et al. |
| 8,602,333 | B2 | 12/2013 | Bradley et al. |
| 2003/0012833 | A1 | 1/2003 | Freissle et al. |
| 2003/0085310 | A1 | 5/2003 | Galanty et al. |
| 2004/0112827 | A1* | 6/2004 | May ..... B01D 29/111 210/497.01 |
| 2005/0040083 | A1 | 2/2005 | Freissle et al. |
| 2006/0096895 | A1 | 5/2006 | Reid-Robertson et al. |
| 2010/0307961 | A1 | 12/2010 | Van Rensburg |

* cited by examiner

SIZING SCREENS FOR COMMINUTING MACHINES

CROSS-REFERENCE TO RELATED APPLICATION

The present application is a continuation of U.S. patent application Ser. No. 13/748,379, filed Jan. 23, 2013, now abandoned, which claims the benefit of U.S. Provisional Patent Application Ser. No. 61/593,613, filed Feb. 1, 2012, which application is hereby incorporated by reference in its entirety.

TECHNICAL FIELD

This invention pertains to screens for comminuting machines. More particularly, this invention pertains to one or more sizing screen arrangements for use with a rotary grinder.

BACKGROUND

Various machines have been developed for comminuting materials. Examples, with common names, include: shredders, having a relatively slow speed comminuting apparatus typically used for ripping and breaking hard, tough materials apart into relative coarse particles; chippers having a relatively high speed comminuting apparatus (either a rotating disc or a rotating drum) with sharp material reducing components typically used for cutting wood materials into small chips; and grinders having a relatively high speed comminuting apparatus (e.g., a rotating drum typically with robust and blunt material reducing components) that is located adjacent a sizing screen that is used to tear and shatter materials into a variety of particle sizes.

Grinders typically include reducing hammers on which replaceable grinding cutters (i.e., grinding tips or grinding elements) are mounted. Grinding cutters generally have relatively blunt ends suitable for reducing material through blunt force impactions. Screens are often used to control the size of the reduced material output from grinders. In contrast to the grinding cutters used on grinders, chippers typically include relatively sharp chipping knives configured to reduce material through a cutting/slicing action as opposed to a grinding action.

SUMMARY

Aspects of the disclosure relate to a grinder for grinding relatively loose materials. The grinder includes a reducing unit including a plurality of cutters disposed on hammer members; and an arcuate screen positioned concentric to the reducing unit. The arcuate screen defines multiple tracks of apertures. Each track of apertures extends in the path of travel of one of the cutters so that only one respective cutter passes over each track and each cutter passes over only the respective one of the tracks. A width of each cutter is wider than a width of the respective track.

Other aspects of the disclosure relate to a screen for use with a grinder including an arcuate body having a screening defining plurality of apertures. The apertures are arranged in tracks that extend parallel to an upstream-to-downstream dimension of the screening region. Each aperture defines a parallelogram having one pair of edges extending parallel to the upstream-to-downstream dimension of the screening region. Each aperture also has a second pair of edges that are angled relative to the upstream-to-downstream dimension of the screening region. Each aperture defines a downstream corner that is located farther downstream along the upstream-to-downstream dimension than any other portion of the aperture. The downstream corner has a radius of at least 3/16 of an inch.

Other aspects of the disclosure relate to a screen arrangement for use with a grinder including a first screen having an arcuate body. The arcuate body has a screening region defining plurality of apertures; and a fastening region that extends between the screening region and a perimeter of the arcuate body. The fastening region defines notches that are differently shaped than the apertures of the screening region.

Other aspects of the disclosure relate to a screen arrangement including a frame including a plurality of parallel support arrangements coupled together by a plurality of parallel cross-piece arrangements; a plurality of arcuate screens configured to be coupled to the frame; and a plurality of coupling members configured to secure the screens to the frame. Each screen includes a fastening region at which notches are disposed. A fastening section of each coupling member is configured to fit within one of the notches of at least one of the screens and is configured to be fastened to one of the support arrangements of the frame. A clamping section of each coupling member is configured to extend over an inner surface of the at least one of the screens.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
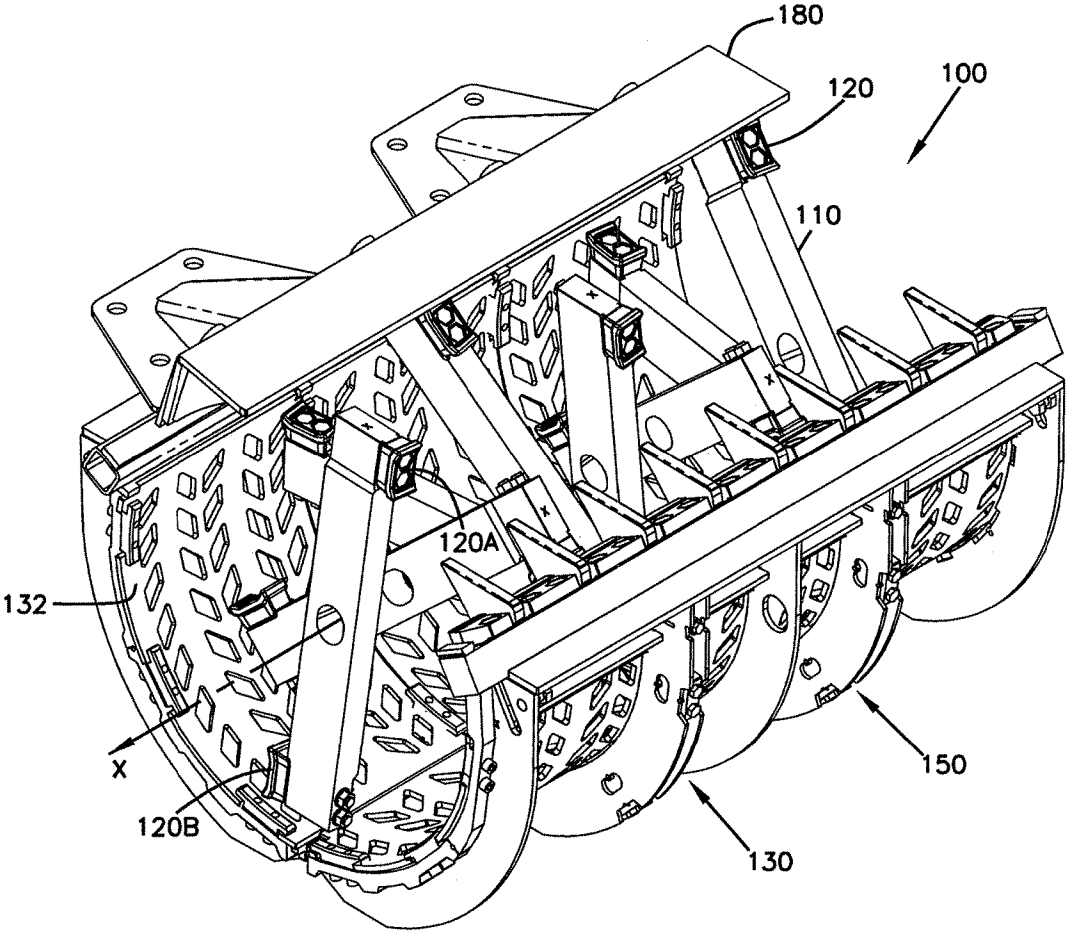
FIG. 1 is top perspective view of an example screen arrangement partially circumferentially surrounding an example reducing unit.
Figure 2:
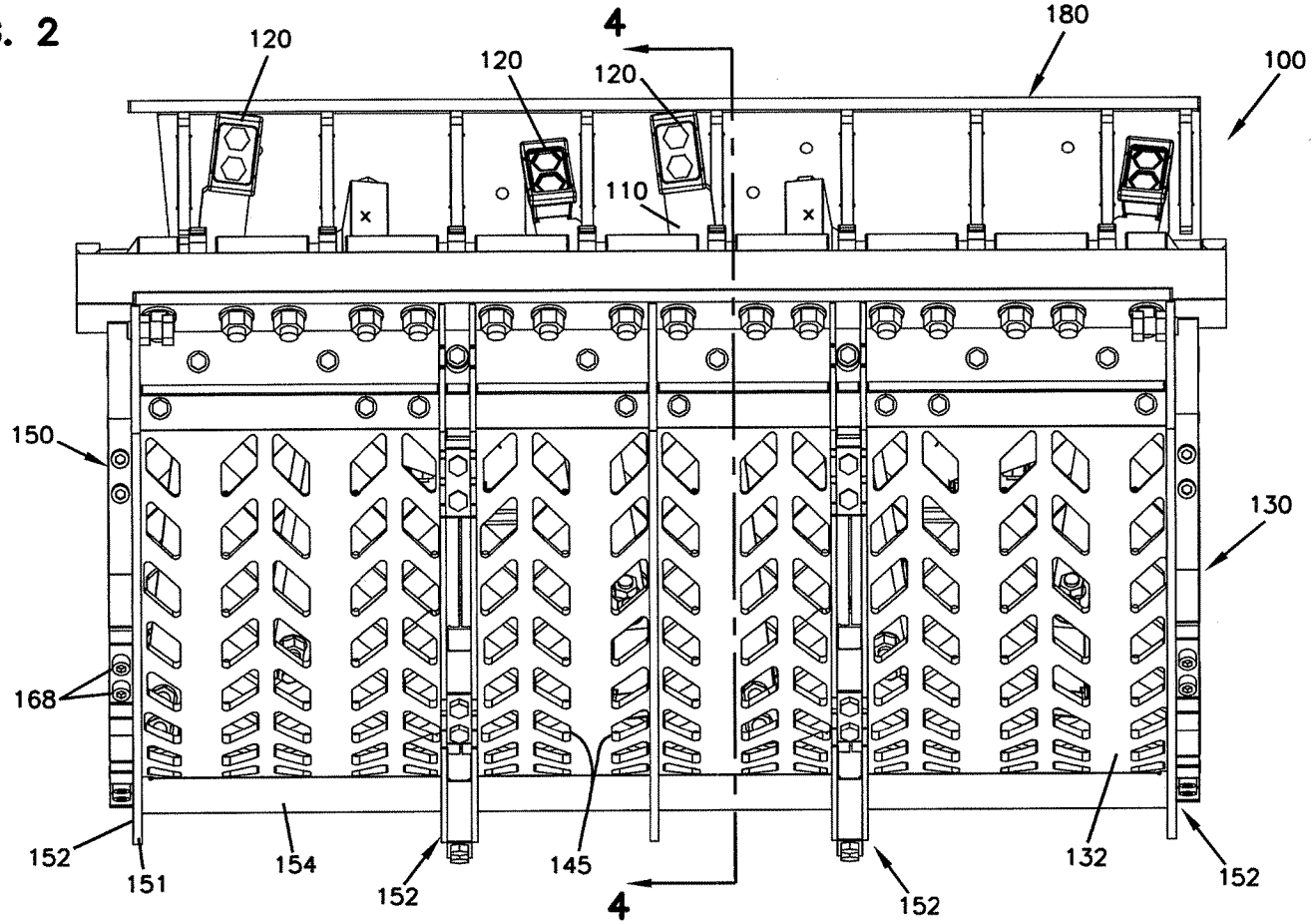
FIG. 2 is a front elevational view of the screen arrangement and reducing unit of FIG. 1.
Figure 3:
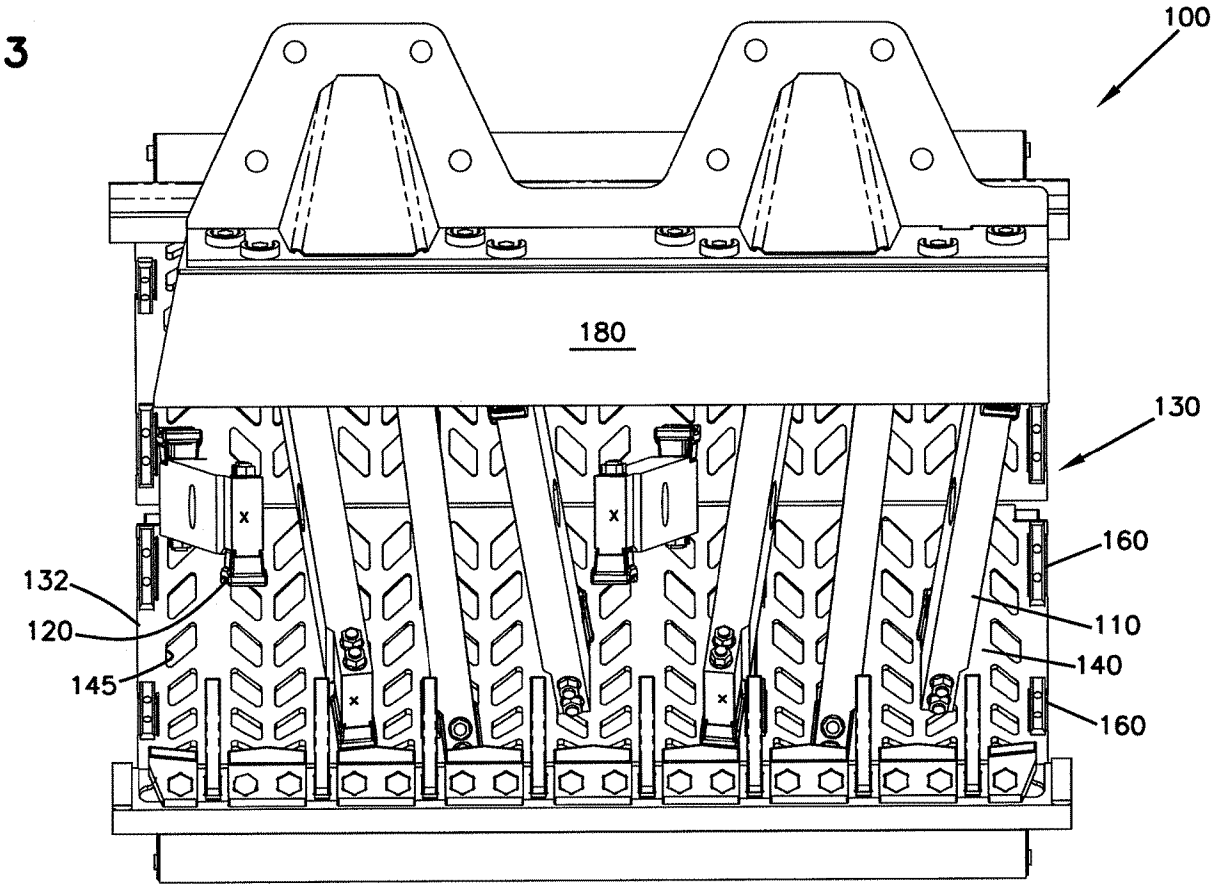
FIG. 3 is top plan view of the screen arrangement and reducing unit of FIG. 1.

Reference will now be made in detail to the exemplary aspects of the present disclosure that are illustrated in the accompanying drawings. Wherever possible, the same reference numbers will be used throughout the drawings to refer to the same or like structure.

Comminuting machines each have an infeed section, a comminution section, and a discharge section. The comminution sections include rotary reducing units used to reduce material through comminution actions such as grinding, cutting, chopping, slicing, chipping, etc. The rotary reducing units can include carriers (e.g., drums or other carriers) that carry a plurality of reducing components (e.g., edges, grinding members, cutters, plates, blocks, blades, bits, teeth, hammers, shredders or combinations thereof) around rotational cutting paths surrounding central axes of rotation of the carriers. Example carriers are disclosed in U.S. Pat. Nos. 7,204,442; 5,507,441; 7,213,779; and 6,840,471, the disclosures of which are hereby incorporated herein by reference In use, the carriers are rotated about their axes to cause the reducing components to impact material desired to be reduced, thereby causing reduction of the material via one or more comminution actions. One or more screens can be provided at least partially surrounding the rotary reducing units for providing additional comminution action and/or for controlling the size of the reduced material output from the comminution machines. Example comminution machines in accordance with the principles of the present disclosure can include tub grinders, horizontal grinders, chippers, shredders or other material reduction machines.

Referring to FIGS. 1-4, a rotary reducing unit 100 (e.g., a comminuting drum) is mounted to a comminuting machine and is coupled via a shaft to an engine for rotating the reducing unit 100. The rotary reducing unit 100 includes a plurality of radially extending hammer members 110 (e.g., bar-style hammers) that are configured to rotate about an axis X. In certain implementations, the axis X is generally horizontal. The rotation of the hammer members 110 defines a circular reducing boundary (e.g., an outermost reducing perimeter) RP of the rotary reducing unit 100 (see FIG. 4). A deflection screen 180 may be provided to reduce the trajectory and/or momentum of material ejected from the reducing boundary RP of the reducing unit 100.

In some implementations, the hammer members 110 are generally orthogonal to the rotation axis X. In other implementations, however, the hammer members 110 may be oriented at an angle ranging between 50° and 130° from the rotation axis X (e.g., see FIG. 3). In some implementations, the reducing unit 100 includes a reducing component carrier (e.g., a cylindrical drum) that is rotatable about the axis of rotation X. The hammers 110 are mounted to the drum. For example, in certain implementations, the hammers 110 have end portions that project radially outwardly from an outer cylindrical skin of the drum.

Cutters 120 are mounted (e.g., using fasteners) to distal ends of the hammer members 110. In the example shown, a block-style cutter 120 is mounted to a leading face at each of the opposite ends of each hammer member 110. In other implementations, the cutters 120 may be mounted directly to a drum or other type of rotational carrier. In still other implementations, blade-style cutters may be mounted to the hammer members 110 instead of or in addition to the block-style cutters 120. As the hammer members 110 are rotated about the axis X, each of the cutters 120 spins along a respective annular cutting path. The cutters 120 engage and crush waste material that enters the cutting paths.

In some implementations, each hammer member 110 extends from a first distal end to a second distal end. A first cutter 120A (FIG. 1) is mounted to the first distal end of a first hammer member 110 and a second cutter 120B is mounted to the second distal end. In certain implementations, the first cutter 120A is mounted to one side of the hammer member 110 at the first distal end and the second cutter 120B is mounted to an opposite of the hammer member 110 at the second distal end so that a first cutting path of the first cutter 120A is offset from a second cutting path of the second cutter 120B (e.g., see FIG. 3).

A front side 122 of each cutter 120 can be referred to the "reducing side" or "leading side" of the cutter 120. During the reduction of material, the cutter 120 is moved such that the front side 122 leads the cutter 120 and impacts the material desired to be reduced. The front side 122 of the cutter 120 includes a main central region (i.e., a main central face) defining openings that are configured to receive fasteners to secure the cutters 120 to the hammer members 110.

The front side 122 also includes reducing edges 124, 126 positioned on opposite sides of the main central region. The reducing edges 124, 126 extend across a width of the block-style cutter 120. The reducing edges 124, 126 are parallel to one another. In some implementations, the first and second reducing edges 124, 126 are wedge-shaped and project forwardly from the main central region of the block-style cutter 120. These edges 124, 126 can have a rounded/blunt configuration adapted for grinding material desired to be reduced. In other embodiments, the edges 124, 126 can be sharp edges, such as knife edges, adapted for chipping material being reduced.

Figure 4:
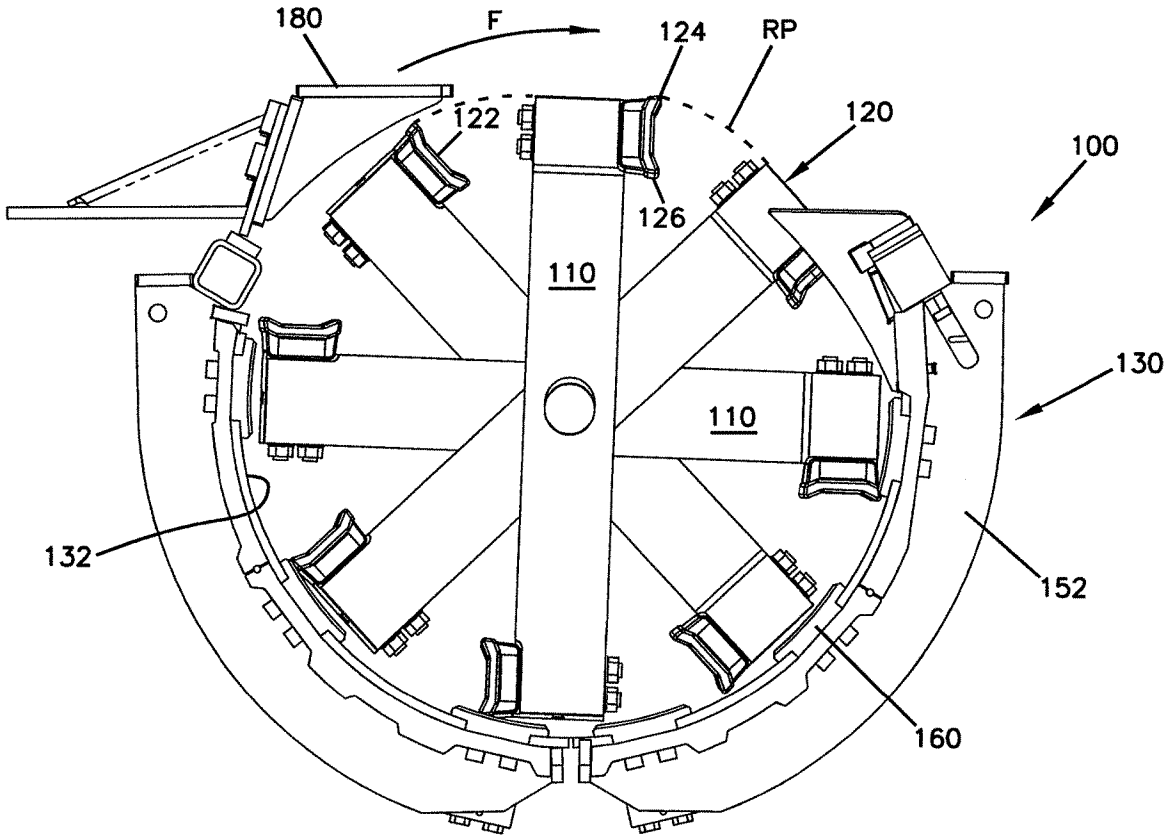
FIG. 4 is a cross-sectional view taken along the 4-4 line of FIG. 2.

As shown at FIG. 4, the first reducing edges 124 of the block-style cutter 120 are positioned at the reducing perimeter RP and the second reducing edges 126 are inwardly offset from the reducing perimeter RP. The second reducing edges 126 are provided on the block-style cutters 120 so that when the first reducing edges 124 become worn, the block-style cutters 120 can be removed from the hammers 110 and then remounted on the hammers 110 in a reverse configuration with the second reducing edges 126 positioned at the reducing perimeter RP.

A sizing screen arrangement 130 is mounted to the reducing unit 100 so as to extend at least partially around the reducing unit 100. The sizing screen arrangement 130 is mounted at a position offset from the reducing boundary RP of the reducing unit 100 so that the cutters 120 may freely spin within the volume of the screen arrangement 130. In certain implementations, the sizing screen 130 is offset from the reducing boundary RP by a distance ranging between 0.4 and 0.2 inches. When the waste material intersects the reducing perimeter RP, the material is impacted by the cutters 120 and initially reduced. Contact between the material and the cutters 120 forces the material into a comminution chamber 131 (FIG. 4).

The comminution chamber 131 is defined between the reducing unit 100 and the sizing screen 130. Within the comminution chamber 131, the material is ground and sliced by the cutters 120. The sizing screen arrangement 130 defines one or more exit apertures 145 through which material falls from the chamber 131 during operation of the reducing unit 100. Waste material drops through apertures 145 of the sizing screen 130 to a discharge system that carries the reduced material away from the comminution chamber 131 to a collection location. In certain implementations, the discharge system includes a conveyer belt and/or a conveyor for discharge from the reducing machine (e.g., from the tub grinder or horizontal grinder).

Figure 5:
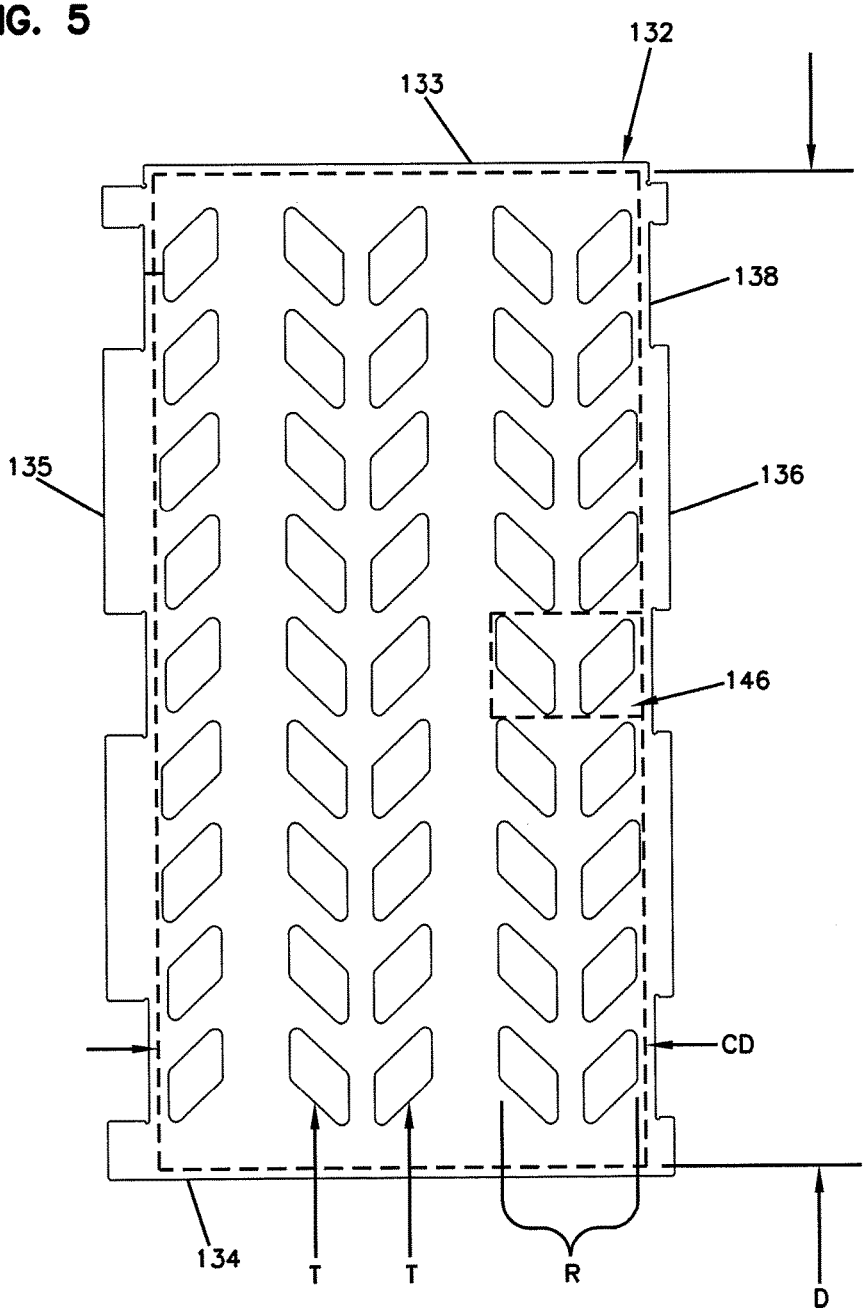
FIG. 5 is a front elevational view of an example screen suitable for use in any of the screen arrangements disclosed herein.

Each sizing screen arrangement 130 includes at least one screen 132 mounted to a frame 150. FIG. 5 illustrates one example implementation of a screen 132 suitable for use in a screen arrangement 130. The screen 132 has a length extending from first end 133 to a second end 134 and has a width extending from a first side 135 to a second side 136. The screen 132 defines a screening region 140 and a fastening region 137. The screening region 140 defines one or more apertures 145 through which the material passes when reduced by the cutters 120. The fastening region 137 is configured to facilitate coupling the screen 132 to the frame 150 as will be described in more detail herein.

The screening region 140 of the example screen 132 has an upstream-most boundary 141 separated from a downstream-most boundary 142 by an upstream-to-downstream screen dimension D (FIG. 5). When the screen arrangement 130 is mounted to a comminution machine 100, the upstream-to-downstream dimension D extends parallel to a direction of travel F (FIG. 4) of the material reducing components 120 of the comminution machine 100. The screening region 140 also has a first side boundary 143 (e.g., left side boundary) separated from a second side boundary 144 (e.g., a right side boundary) by a cross-screen dimension CD (FIG. 5). The cross-screen dimension CD is transversely oriented relative to the upstream-to-downstream screen dimension D.

The apertures 145 of the screening region 140 are arranged in rows R that extend along the upstream-to-downstream dimension D of the screening region 140. Each row R defines a plurality of apertures 145. In certain implementations, each row R includes a plurality of pairs 146 of laterally aligned apertures 145. Each row R is located on the screening region 140 such that only one of the hammer members 110 of the reducing unit 100 is aligned with that row R. The rows R also are located so that each hammer member 110 is aligned with only the respective one of the rows R.

In some implementations, the apertures 145 in each row R are aligned along one or more tracks T that extend parallel to the upstream-to-downstream dimension D. In certain implementations, each row R includes a first track T1 and a second track T2. In some such implementations, the aperture pairs 146 are disposed so that a first aperture 145 of each pair 146 is located in the first track T1 and a second aperture 145 of each pair 146 is located in the second track T2. In certain implementations, the first cutting path of the first cutter 120A of each hammer member 110 aligns with the first track T1 of the respective row R and the second cutting path of the second cutter 120B of each hammer member 110 aligns with the second track T2 of each row R.

In some implementations, the screen 132 has an even number of tracks T1, T2. In other implementations, however, the screen 132 has an odd number of tracks T1, T2. In such implementations, one track of the screen 132 cooperates with a track of an adjacent screen 132 in the screen arrangement 130 to form a row R. In certain implementations, a screen 132 having an even number of tracks may have two tracks that form rows with adjacent screens (e.g., one track at the left side and one track at the right side). In the example shown in FIG. 5, the screening region 140 of the example screen 132 has five tracks forming two complete rows R and one partial row. In other implementations, however, the screening region 140 may define a greater or lesser number of tracks of apertures 145 forming a greater or lesser number of rows.

Figure 6:
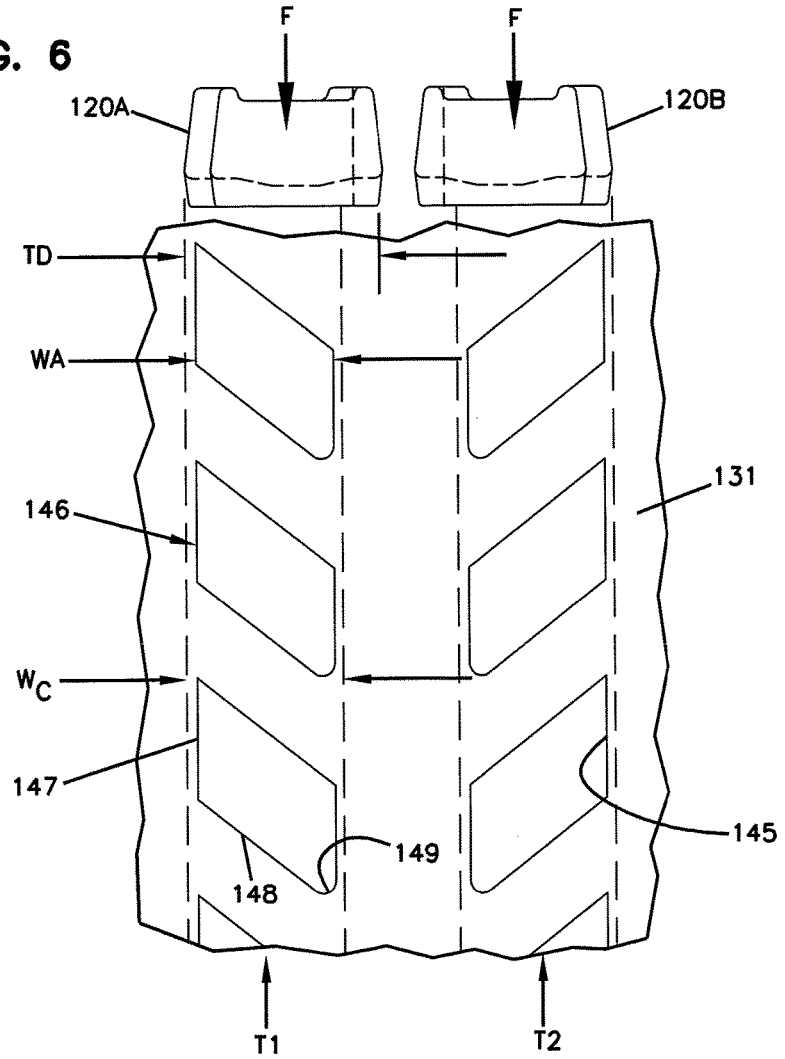
FIG. 6 schematically illustrates a pair of example cutters aligned along adjacent tracks in a row of apertures defined in an example screen.
Figure 7:
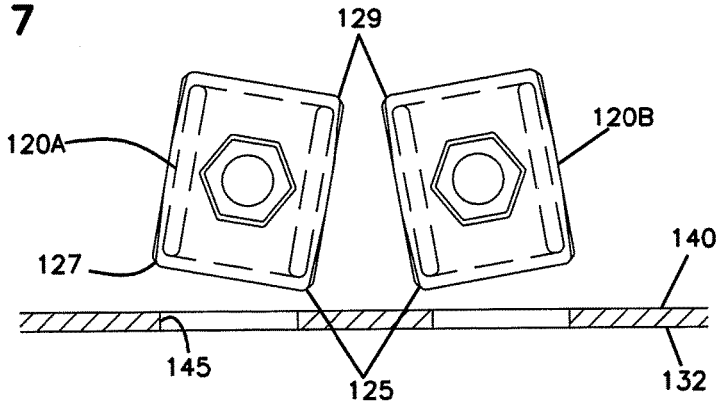
FIG. 7 schematically illustrates an example tilted orientation of the cutters of FIG. 6 relative to the inner surface of the example screen.

FIGS. 6 and 7 illustrate the alignment between the cutters 120 and the tracks of the screening region 140. In the example shown in FIGS. 6 and 7, a first cutter 120A is aligned with a first track T1 and a second cutter 120B is aligned with a second track T2. In one example implementation, the first and second tracks T1, T2 form a row R and the first and second cutters 120A, 120B are coupled to the same hammer member 110. The cutters 120A, 120B are configured to move along the tracks T1, T2, respectively, in a flow direction F. Each of the cutters 120A, 120B has a width $W_C$ that is larger than a width $W_A$ of the apertures 145 of the respective tracks T1, T2. In certain implementations, the cutters 120A, 120B are aligned with the tracks T1, T2 so that at least a portion of the cutter 120A, 120B overlaps the apertures 145 of the respective track T1, T2 on both sides of the apertures 145 (e.g., see FIG. 6).

In some implementations, the cutters 120 are not arranged relative to the screen 132 so that the first reducing edges 124 are parallel to the inner surface of the screening region 140. Rather, the cutters 120 may be oriented (e.g., tilted) so that one side or corner 125 of the first reducing edge 124 is disposed closer to the inner surface of the screening region 140 than the opposite side or corner 127 of the first reducing edge 124 (e.g., see FIG. 7). In such implementations, each cutter 120 also has a cross-dimension TD that extends laterally between the outermost corners (e.g., corners 127 and 129 in FIG. 7) of the cutter 120. The cross-dimension TD of each cutter 120 is larger than the aperture width $W_A$ of the respective track T1, T2. In certain implementations, the width $W_C$ of the cutter 120 may be smaller than the aperture width $W_A$ when the cutter 120 is intended to be tilted and the cross-dimension TD is larger than the aperture width $W_A$.

In the example shown in FIG. 6, the apertures 145 are generally shaped as parallelograms. Each parallelogram-shaped aperture 145 has one pair of edges 147 extending parallel to the upstream-to-downstream dimension D of the screening region 140. Each parallelogram-shaped aperture 145 also has a second pair of edges 148 that are angled relative to the upstream-to-downstream dimension D of the screening region 140. In some implementations, the second pair of edges 148 of each aperture 145 are angled between 20 degrees and 50 degrees from the upstream-to-downstream dimension D. In certain implementations, the second pair of edges 148 of each aperture 145 are angled between 30 degrees and 50 degrees from the upstream-to-downstream dimension D. In certain implementations, the second pair of edges 148 of each aperture 145 are angled between 20 degrees and 40 degrees from the upstream-to-downstream dimension D.

In some implementations, the second pair of edges 148 of the apertures 145 of the first track T1 of one or more rows R are angled in a first direction relative to the dimension D and the second pair of edges 148 of the apertures 145 of the second track T1 are angled in a second direction that is different from the first direction. In certain implementations, the apertures 145 of each track T1, T2 of one or more rows R are angled towards each other, thereby forming a chevron-style pattern or portion thereof.

Each aperture 145 defines a downstream corner 149 that is located farther downstream along the flow direction F than any other portion of the aperture 145. In certain implementations, the cutters 120 are positioned so that the side 125 of the reducing edge 124 of the respective cutter 120 that is closest to the screen 132 passes over the downstream corner 149. In certain implementations, the downstream corners 149 of aperture pairs 146 face each other (see FIG. 6). In some implementations, the downstream corner 149 is curved (i.e., radiused) instead of having a sharp angle where the respective edge 147 meets the respective edge 148. In some implementations, the downstream corner 149 has a radius of at least 1/16 of an inch. In certain implementations, the downstream corner 149 has a radius of at least 1/8 of an inch. In certain implementations, the radius is at least 3/16 of an inch.

Figure 8:
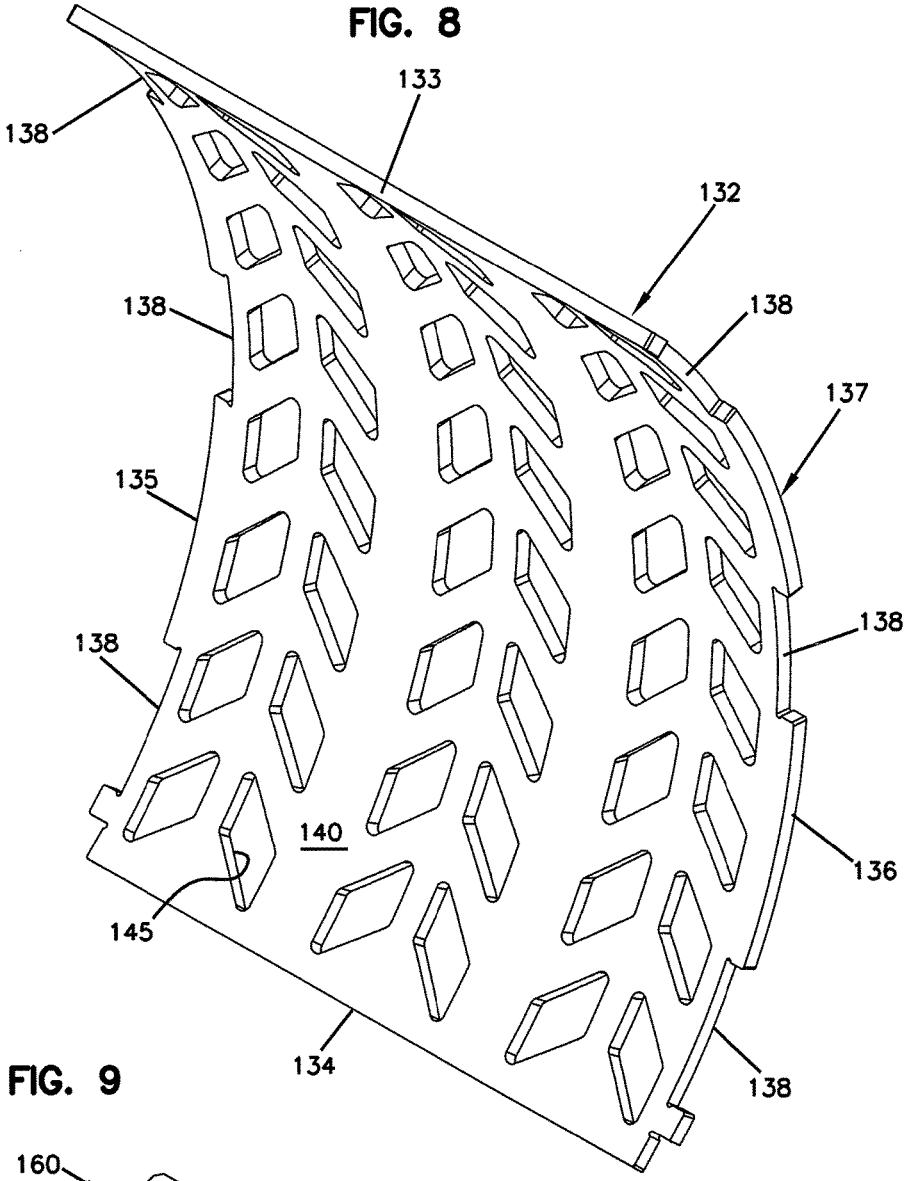
FIG. 8 is a front perspective view of an example screen suitable for use in any of the screen arrangements disclosed herein.
Figure 9:
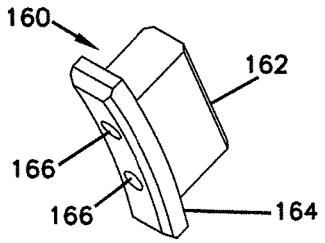
FIG. 9 is a perspective view of a coupling member that is configured to hold one or more screens to a frame to form the screen arrangement.
Figure 10:
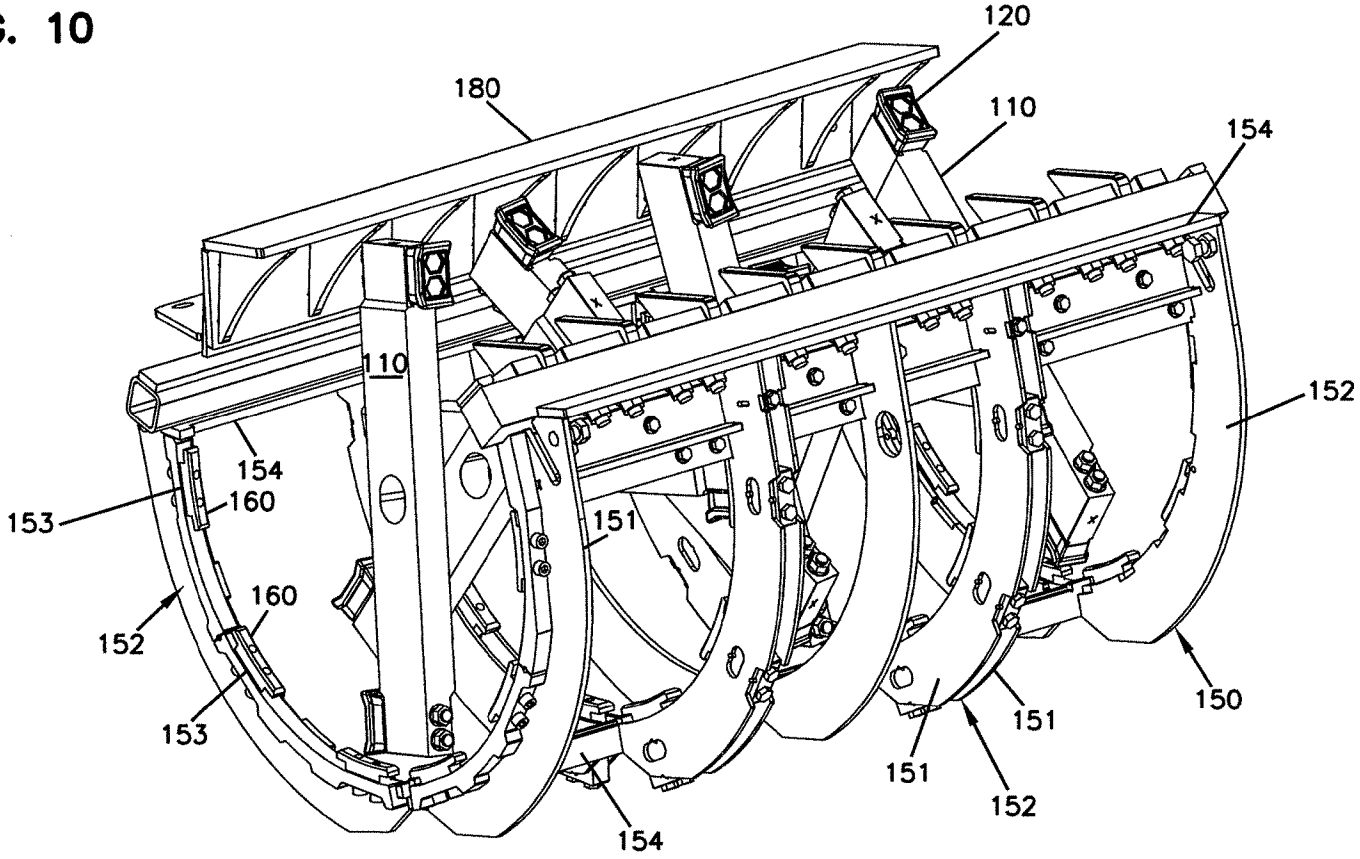
FIG. 10 is a perspective view of an example frame suitable for receiving one or more screens to form a screen arrangement.

FIGS. 8-12 illustrate how one or more screens 132 can be mounted to a frame 150 (FIG. 10). As shown in FIG. 8, the screen 132 has an arcuate body that defines the fastening region 137 and the screening region 140. As described above, the screening region 140 defines a plurality of apertures 145. In some implementations, the fastening region 137 of the screen 132 is defined along at least some of the outer edges 133-136 of the screen 132. For example, in certain implementations, the fastening region 137 is disposed between the first and second side boundaries 143, 144 of the screening region 140 and the side edges 135, 136 of the screen 132, respectively. In certain implementations, the fastening region 137 may be defined between the upstream and/or downstream boundaries 141, 142 of the screening region 140 and the upstream and downstream edges 133, 134 of the screen 132.

The fastening region 137 defines one or more notches through which a coupler member (e.g., coupler member 160) may extend to secure the screen 132 to the frame 150. In some implementations, the notches are shaped differently than the apertures 145 defined in the screening region 140. For example, the notches may have a different size, pattern, or orientation from the apertures 145. In the example shown, the notches define a generally rectangular shape that is elongated along the upstream-to-downstream dimension D of the screen 132. In other implementations, the notches may have a different shape. In certain implementations, the notches extend over a greater distance along the upstream-to-downstream dimension D than any of the apertures 145. In other implementations, the notches may be smaller than the apertures 145.

In some implementations, one or more of the notches are open-ended notches 138 (e.g., see FIG. 8). In other implementations, one or more of the notches are closed-ended notches 139 (e.g., see FIG. 15). In some implementations, the fastening region 140 defines at least one open-ended notch 138 along both side edges 135, 136 of the screen 132. In certain implementations, the fastening region 140 may define a plurality of open-ended notches 138 along both sides 135, 136 of the screen 132. In the example shown in FIG. 8, the fastening region 137 defines three open-ended notches 138 along each side 135, 136 of the screen 132. In other implementations, one or more of the open-ended notches 138 may be closed-ended notches 139. In still other implementations, notches 138, 139 may be defined in the top and bottom edges 133, 134 of the screen 132.

FIG. 10 illustrates an example frame 150 to which one or more screens 132 may be mounted to form the screen arrangement 130. The frame 150 includes one or more parallel support arrangements 152 coupled together by a plurality of parallel cross-piece arrangements 154. In some implementations, the support arrangements 152 include one or more arcuate members 151. In general, the support arrangements 152 form the ribs or gussets of the frame 150. The support arrangements 152 are laterally spaced from each other along the rotational axis X of the reducing unit 100. A screen 132 is disposed on the frame 150 so that the cross-dimension CD of the screen 132 extends between two support arrangements 152.

One or more coupling members 160 are configured to hold the screen 132 to the frame 150. One example coupling member 160 is shown in FIG. 9. The coupling member 160 includes a fastening section 162 and a clamping section 164. The fastening section 162 of each coupling member 160 is sized and configured to fit within one of the notches 138, 139 of at least one of the screens 132. The fastening section 162 also is sized and configured to engage a coupling region 153 of a support arrangement 152. One or more fastener apertures 166 are defined through the coupling member 160. In the example shown, two fastener apertures 166 extend from a top of the coupling member 160, through the fastening section 162, to a bottom of the coupling member 160.

The clamping section 164 of each coupling member 160 is configured to extend over a portion of the fastening section 137 of at least one screen 132. In the example shown, the clamping section 164 extends over the inner surface of the screen 132. In some implementations, the clamping section 164 overhangs at least one side of the fastening section 162. In certain implementations, the clamping section 164 overhangs opposite sides of the fastening section 162. In the example shown, the clamping section 164 is elongated along a longitudinal axis of the coupling member 160 and overhangs the clamping section 164 along the longitudinal axis. In other implementations, however, the clamping section 164 may overhang lateral sides of the fastening section 162 instead of or in addition to the longitudinal sides.

Figure 12:
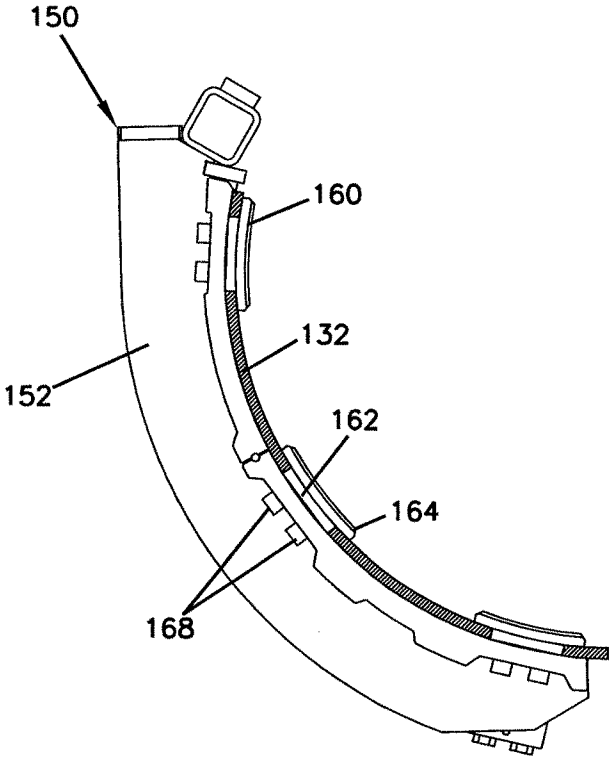
FIG. 12 is a side elevational view of the screen arrangement of FIG. 11 with the coupling members fastened to the frame and retaining the screen therebetween.
Figure 11:
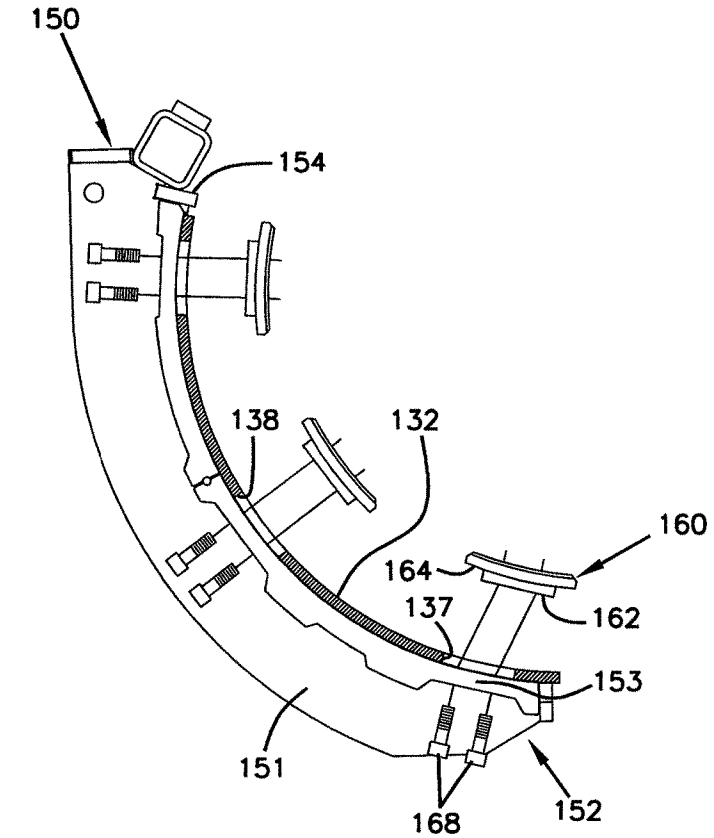
FIG. 11 is a side elevational view of an example screen arrangement with the screen, coupling members, and fasteners exploded outwardly from the frame.

For example, FIGS. 11 and 12 illustrates multiple coupling members 160 aligned with notches of a screen 132 and aligned with coupling regions 153 of a support arrangement 152. Fasteners 168 are disposed at an opposite side of the support arrangement 152 and aligned with the fastener apertures 166 defined in each coupling member 160. In the example shown, three coupling members 160 are aligned with the open-ended notches 138 of the screen 132 shown in FIG. 8.

The screen 132, coupling members 160, and fasteners 168 are shown exploded outward from the support arrangement 152 in FIG. 11. The fastening section 162 of each coupling member 160 is configured to extend through one of the open-ended notches 138 of the screen 132 and to couple to one of the coupling regions 153 of the support arrangement 152. The clamping section 164 of each coupling member 160 is configured to extend over an inner surface of the screen 132 to clamp or otherwise hold the screen 132 between the clamping section 164 and the support arrangement 152 as shown in FIG. 12.

Figure 13:
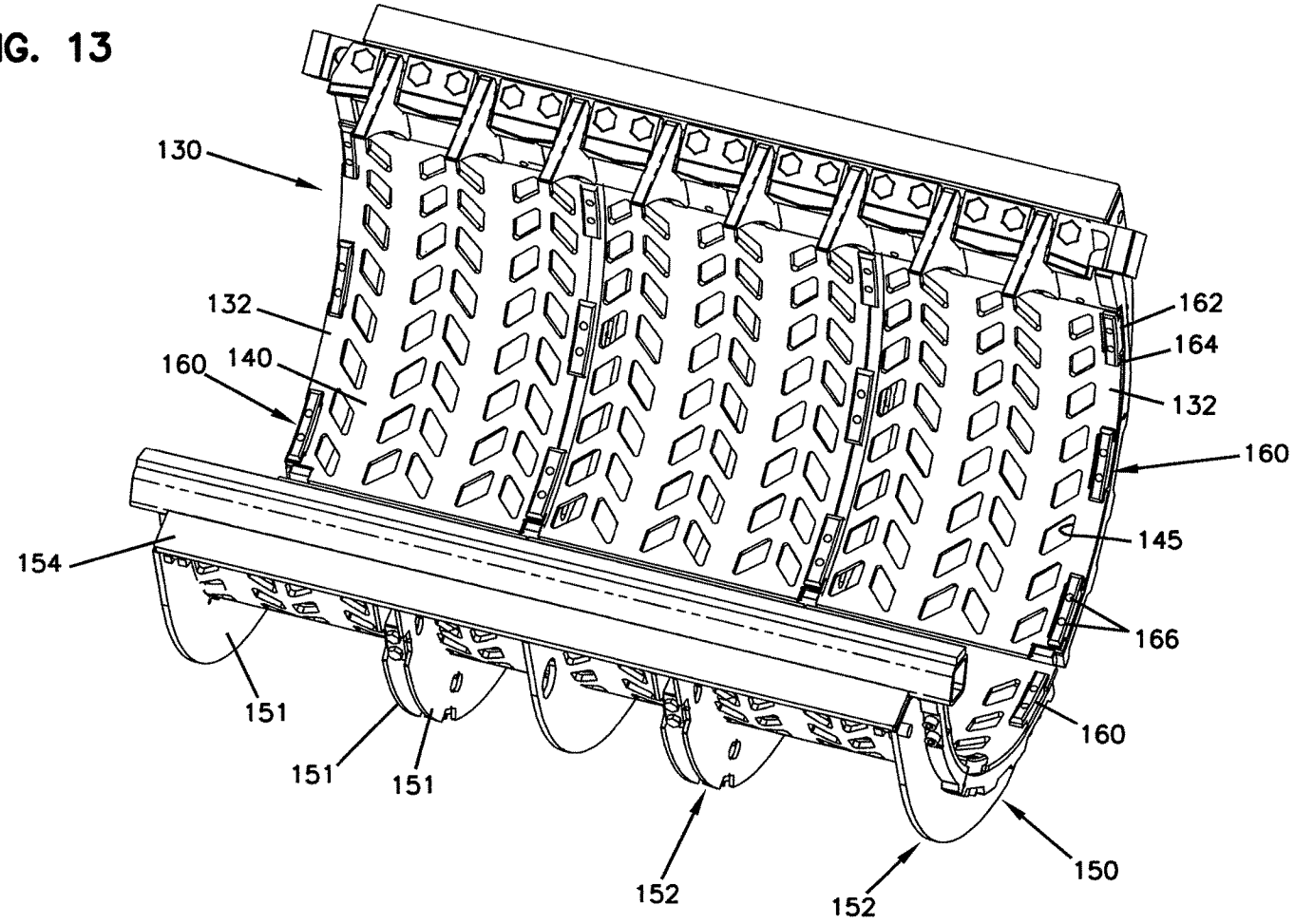
FIG. 13 is a top perspective view of an example screen arrangement including six screens mounted to a frame using coupling members.

FIG. 13 illustrates an example screen arrangement 130 including six screens 132 mounted to a frame 150. In the example shown, each screen 132 defines three open-ended notches 138 at each side 136, 137 of the screen 132. Coupling members 160 fit within the slots 138 to hold the screens 132 to the frame 150. In certain implementations, a single coupling member 160 aids in holding two adjacent screens 132 to the frame 150. For example, the fastening section 162 of a single coupling member 160 may fit between two laterally aligned, open-ended notches 138 of adjacent screens 132 and the clamping section 164 of that coupling member 160 may extend over a portion of the surface of both of the adjacent screens 132.

Figure 14:
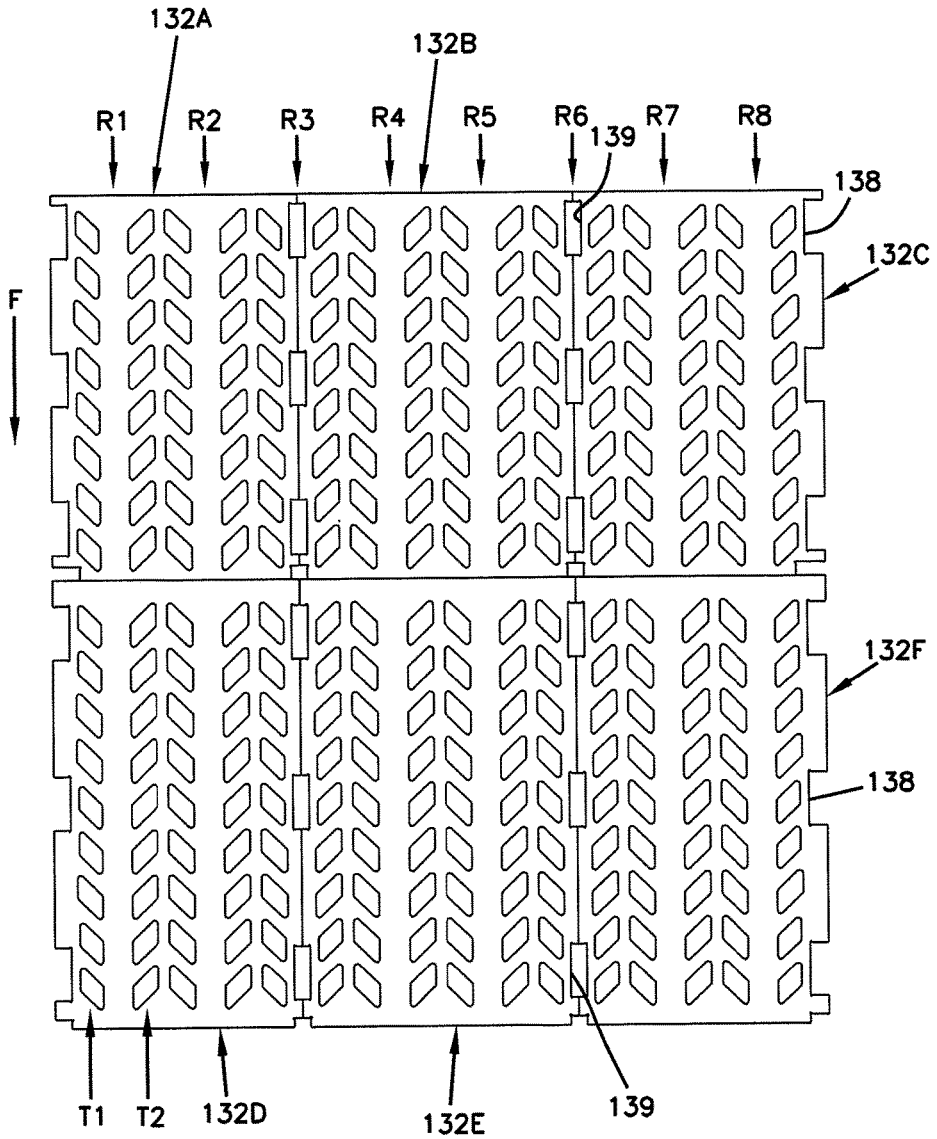
FIG. 14 illustrates one example frame configuration shown flattened for ease in viewing, the frame configuration including six example screens that each define open-ended notches.

For example, FIG. 14 illustrates the alignment of the screens 132 of FIG. 13 without the coupling members 160 or frame 150. For ease in viewing, the screens 132 are flattened in FIG. 14. The six screens 132A-132F are arranged in a 2×3 grid pattern. In other implementations, however, the screens 132 of a screen arrangement 130 may be arranged in any desired pattern (e.g., 1×2, 1×3, 1×4, 1×6, 2×1, 2×4, 3×3, etc.). Each of the screens 132A-132F shown in FIG. 14 defines open-ended notches 138 at side edges 135, 136 of the screens 132. The open-ended notches 138 of laterally adjacent screens 132 align to form closed-ended notches 139 sized and configured to receive the fastening section 162 of a coupling member 160.

The aperture tracks T1, T2 of longitudinally adjacent screens 132 align to form extended tracks along the flow direction F. In the example shown, the tracks T1, T2 are paired into eight rows R1-R8 that are laterally spaced along the screen arrangement 130. The top left screen 132A includes two complete rows R1 and R2. The top left screen 132A also includes the first track T1 of the third row R3. The top middle screen 132B includes two complete rows R4 and R5. The top middle screen 132B also includes the second track T2 of the third row R2 and the first track T1 of the sixth row R6. In other implementations, however, each screen 132A-132F may include only complete rows of apertures 145.

Figure 15:
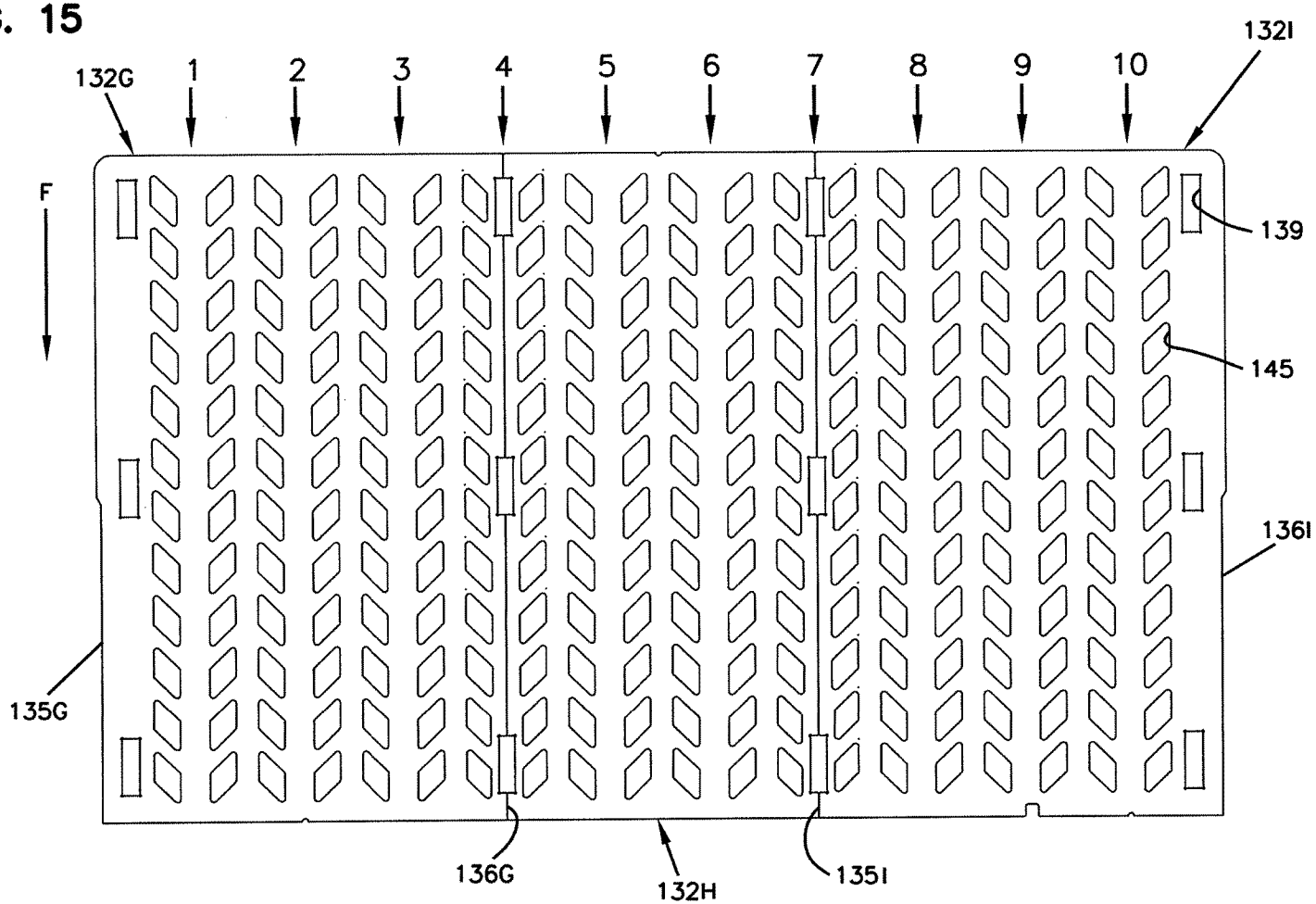
FIG. 15 illustrates another example frame configuration shown flattened for ease in viewing, the frame configuration including three example screens, some of which define closed-ended notches.

FIG. 15 illustrates an alternative arrangement for screens 132 to be mounted to a frame 150. The screen arrangement shown in FIG. 15 includes three screens 132G-132I. The outer screens 132G, 132I have a larger cross-dimension CD than the middle screen 132H. The outer screens 132G, 132I each define closed ended notches 139 along the respective outer side edge 135G, 136I of the screen 132. The outer screens 132G, 132I also each define open-ended notches 138 along the respective inner side edge 136G, 135I of the screen 132. The middle screen 132H defines open-ended notches 138 along both side edges. The notches 138 of the middle screen 132H are sized and positioned to adjoin the open-ended notches 138 of the outer screens 132G, 132I to form closed-ended notches 139.

In the example shown in FIG. 15, the apertures 145 are positioned in tracks extending in a flow direction F. The screens 132G-132I may have different numbers of apertures 145. In certain implementations, the screens 132G-132I may have different arrangements of apertures 145. For example, the outer screens 132G, 132I may have a greater number of tracks than the middle screen 132H. In other implementations, the middle screen 132H may have the greatest number of tracks. In some implementations, two different screen configurations may be alternated through a screen arrangement 130.

In the example shown, the tracks of apertures 145 are paired into ten rows R1-R10 that are laterally spaced along the cross-dimensions CD of the screens 132. The left and right screens 132G, 132I each include three complete rows R1-R3, R8-R10, respectively. Each of the left and right screens 132G, 132I also includes one of the tracks of one row R4, R7. The middle screen 132H includes two complete rows R5 and R6. The middle screen 132H also includes the other track of the two of the rows R4, R7. In other implementations, however, each screen 132 may include only complete rows of apertures 145.

Figure 16:
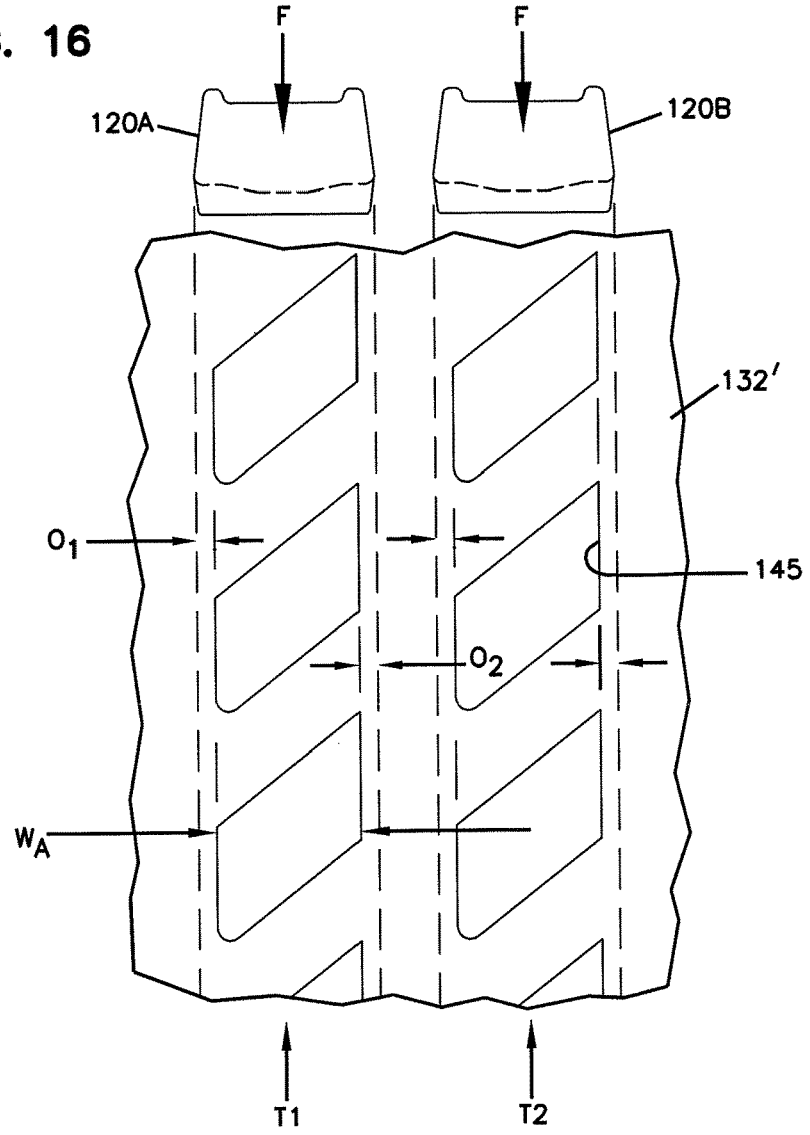
FIG. 16 schematically illustrates a pair of example cutters aligned along adjacent tracks in a row of apertures defined in another example screen defining apertures having a common orientation.
Figure 17:
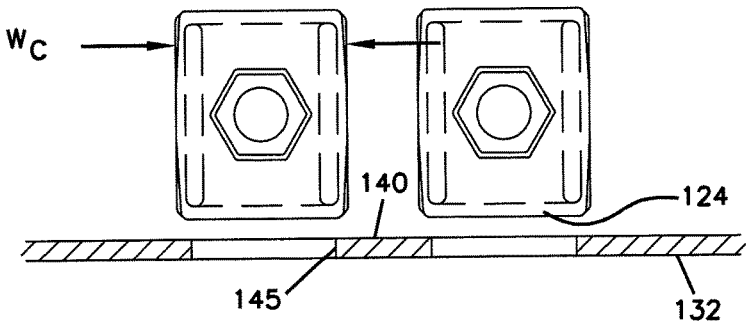
FIG. 17 schematically illustrates an example non-tilted orientation of the cutters of FIG. 16 relative to the inner surface of the example screen.

FIGS. 16 and 17 illustrate an alternative screen 132' having aperture configuration in which the apertures 145 are oriented in a common direction. The alignment between the cutters 120 and the apertures 145 also is shown in FIGS. 16 and 17. A first cutter 120A is aligned with a first track T1 and a second cutter 120B is aligned with a second track T2. As shown in FIG. 17, the cutters 120 are positioned and oriented so that the first reducing edges 124 are parallel to the inner surface of the screening region 140 (see FIG. 17). Each of the cutters 120A, 120B has a width $W_C$ that is larger than a width $W_A$ of the apertures 145 of the respective tracks T1, T2.

In the example shown in FIG. 16, a first side of the cutter 120 overlaps the aperture 145 by an amount O1 and a second side of the cutter 120 overlaps the aperture 145 by an amount O2. In certain implementations, the amount O1 is about equal to the amount O2. In other implementations, the cutter 120 may overlap the aperture 145 more on one side than on the other. In some implementations, the overlap amounts O1, P2 range from about 0.04 inches to about 0.1 inches. In certain implementations, the overlap amounts O1, P2 range from about 0.06 inches to about 0.08 inches. In other implementations, the total difference between the cutter width $W_C$ and the aperture width $W_A$ ranges between about 0.04 inches and about 0.1 inches. In certain implementations, the total difference between the cutter width $W_C$ and the aperture width $W_A$ ranges from about 0.06 inches to about 0.08 inches.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A screen for use with a grinder comprising:

an arcuate body defining a center axis having a screening region extending along an upstream-to-downstream circumferential dimension from an upstream boundary to a downstream boundary and extending along a cross-dimension from a first side boundary to a second side boundary, the screening region defining a plurality of apertures, the apertures being arranged in tracks that extend parallel to the upstream-to-downstream dimension of the screening region;

each aperture defining a parallelogram having one pair of edges extending parallel to the upstream-to-downstream dimension of the screening region, each aperture also having a second pair of edges that are angled relative to the upstream-to-downstream dimension of the screening region, each aperture defining a downstream corner that is located farther downstream along the upstream-to-downstream dimension than any other portion of the aperture, the downstream corner having a radius.

2. The screen of claim 1, wherein the radius is at least 3/16 of one inch.

3. The screen of claim 1, wherein the second pair of edges of each aperture is angled between 20 degrees and 50 degrees from the upstream-to-downstream dimension of the screening region.

4. The screen of claim 3, wherein the second pair of edges of each aperture is angled between 30 degrees and 50 degrees from the upstream-to-downstream dimension of the screening region.

5. The screen of claim 3, wherein the second pair of edges of each aperture is angled between 20 degrees and 40 degrees from the upstream-to-downstream dimension of the screening region.

6. The screen of claim 1, wherein the parallelogram of each aperture has only four corners.

7. The screen of claim 6, wherein the parallelogram of each aperture has closed sides.

8. The screen of claim 1, wherein the one pair of edges extending parallel to the upstream-to-downstream dimension of the screening region form a plurality of corners with the second pair of edges that are angled relative to the upstream-to-downstream dimension of the screening region, and wherein the parallelogram of each aperture has closed sides.

9. The screen of claim 8, wherein the one pair of edges extending parallel to the upstream-to-downstream dimension are straight, and the second pair of edges that are angled relative to the upstream-to-downstream dimension are straight.

10. A screen for use with a grinder comprising:

an arcuate body defining a center axis having a screening region extending along an upstream-to-downstream circumferential dimension from an upstream boundary to a downstream boundary and extending along a cross-dimension from a first side boundary to a second side boundary, the screening region defining a plurality of tracks of apertures extending generally parallel to the upstream-to-downstream dimension of the screening region;

each aperture defining a parallelogram having one pair of edges extending parallel to the upstream-to-downstream dimension of the screening region, each aperture also having a second pair of edges that are angled relative to the upstream-to-downstream dimension of the screening region, the apertures being oriented so that the apertures of at least a first of the tracks are angled in a first direction relative to the upstream-to-downstream dimension and the apertures of a second track are angled in a second direction relative to the upstream-to-downstream dimension, the second track being adjacent to the first track and the second direction being different from the first direction.

11. The screen of claim 10, wherein the second pair of edges of the apertures of the first and second tracks converge as the second pair of edges extend in a downstream direction.

12. The screen of claim 10, wherein the screening region defines an even number of tracks, wherein the tracks are paired into rows each including first and second tracks, and wherein the apertures of the first and second tracks of each paired row are configured such that the second pair of edges of the apertures of the first and second tracks converge as the second pair of edges extends in a downstream direction.

13. The screen of claim 10, wherein the second pair of edges of each aperture is angled between 20 degrees and 50 degrees from the upstream-to-downstream dimension of the screening region.

14. The screen of claim 10, wherein the second pair of edges of each aperture is angled between 30 degrees and 50 degrees from the upstream-to-downstream dimension of the screening region.

15. The screen of claim 10, wherein the second pair of edges of each aperture is angled between 20 degrees and 40 degrees from the upstream-to-downstream dimension of the screening region.

16. The screen of claim 10, wherein each aperture defines a downstream corner that is located farther downstream along the upstream-to-downstream dimension than any other portion of the aperture, the downstream corner having a radius of at least 3/16 of an inch.

17. A screen for use with a grinder comprising:

an arcuate body defining a center axis having a screening region extending along an upstream-to-downstream circumferential dimension from an upstream boundary to a downstream boundary and extending along a cross-dimension from a first side boundary to a second side boundary, the screening region defining a plurality of tracks of apertures extending generally parallel to the upstream-to-downstream dimension of the screening region, each aperture defining a parallelogram; and the apertures being shaped such that the apertures of the first and second adjacent tracks of apertures form a chevron pattern.

18. The screen of claim 17, wherein the apertures of the first and second tracks of apertures have upstream and downstream edges oriented at angles in the range of 20 to 50 degrees relative to the upstream-to-downstream dimension.

19. The screen of claim 17, wherein the apertures of the first and second tracks have upstream and downstream edges that are aligned at oblique angles relative to the upstream-to-downstream dimension.

20. The screen of claim 17, wherein the upstream edges of the apertures of the first and second tracks are angled to converge toward each other as the upstream edges extend in a downstream direction, and wherein the downstream edges of the apertures of the first and second tracks are angled to converge toward one another as the downstream edges extend in the downstream direction.

21. The screen of claim 17, wherein each aperture defines a downstream corner that is located farther downstream along the upstream-to-downstream dimension than any other portion of the aperture, the downstream corner having a radius of at least 3/16 of an inch.

22. A screen for use with a grinder comprising:

an arcuate body defining a center axis having a screening region extending along an upstream-to-downstream circumferential dimension from an upstream boundary to a downstream boundary and extending along a cross-dimension from a first side boundary to a second side boundary, the screening region defining a plurality of apertures, the apertures being arranged in tracks that extend parallel to the upstream-to-downstream dimension of the screening region, each aperture having a first pair of straight edges extending parallel to the upstream-to-downstream dimension of the screening region, each aperture also having a second pair of straight edges that are angled relative to the upstream-to-downstream dimension of the screening region, wherein the first straight edges meet the second straight edges to form four corners and enclose the aperture, and wherein each aperture defines a downstream corner that is located farther downstream along the upstream-to-downstream dimension than any other portion of the aperture, the downstream corner having a radius.

23. The screen of claim 22, wherein the apertures are shaped such that the apertures of the first and second adjacent tracks of apertures form a chevron pattern.

24. The screen of claim 1, wherein the apertures are substantially open.

25. The screen of claim 1, wherein the aperture side edges of each aperture define the size of material to be screened through the aperture from a first side to a second side.

26. The screen of claim 1, wherein the screen is configured to be installed at least partially around a reducing unit having a plurality of cutters, wherein each track of apertures of the screen extends in the path of travel of one cutter of the reducing unit so that only one respective cutter passes over each track.

27. The screen of claim 26, wherein the width of each cutter is wider than a width of each respective track of the screen.

* * * * *